US011952165B2

(12) United States Patent
Low

(10) Patent No.: US 11,952,165 B2
(45) Date of Patent: Apr. 9, 2024

(54) ASSEMBLING COMPONENT HAVING LOCKING MECHANISM

(71) Applicant: Engchoon Low, Singapore (SG)

(72) Inventor: Engchoon Low, Singapore (SG)

( * ) Notice: Subject to any disclaimer, the term of this patent is extended or adjusted under 35 U.S.C. 154(b) by 89 days.

(21) Appl. No.: 17/904,376

(22) PCT Filed: Dec. 9, 2019

(86) PCT No.: PCT/CN2019/124054
§ 371 (c)(1),
(2) Date: Aug. 17, 2022

(87) PCT Pub. No.: WO2021/114033
PCT Pub. Date: Jun. 17, 2021

(65) Prior Publication Data

US 2023/0071977 A1 Mar. 9, 2023

(51) Int. Cl.
*B65D 19/00* (2006.01)

(52) U.S. Cl.
CPC ..... *B65D 19/0095* (2013.01); *B65D 2519/00273* (2013.01); *B65D 2519/00293* (2013.01);
(Continued)

(58) Field of Classification Search
CPC ..... B65D 19/0095; B65D 2519/00273; B65D 2519/00293; B65D 2519/00323;
(Continued)

(56) References Cited

U.S. PATENT DOCUMENTS 2,126,278 A * 8/1938 Quayle ..... B65D 19/0075 108/57.23
3,118,400 A * 1/1964 Kemp, Jr. ..... B65D 19/0093 108/57.1
(Continued)

FOREIGN PATENT DOCUMENTS

CN 2692053 Y 4/2005
CN 103068688 A 4/2013
(Continued)

OTHER PUBLICATIONS

International Application Serial No. PCT/CN2019/124054, Preliminary Report on Patentability dated Jun. 23, 2022, 11 pages.
(Continued)

*Primary Examiner* — Jose V Chen
(74) *Attorney, Agent, or Firm* — Polygon IP, LLP

(57) ABSTRACT

The present application discloses an assembled unit having a locking mechanism, comprising a pair of lateral guide rails, a pair of class I plate members, a spine member and at least one eccentric rotation member. Each of the lateral guide rails is configured with a sliding groove along a direction of extension thereof. Both ends of each of the class I plate members can be inserted into the sliding groove of the corresponding lateral guide rail. Both ends of each of the lateral guide rails are respectively configured with an engaging structure. The spine member is configured with a raised sliding block along its direction of extension. On a surface of each of the type I plate members, a class I engaging slot is configured in a direction parallel to the lateral guide rail, the class I engaging slot opening at a side of the class I plate member.

17 Claims, 11 Drawing Sheets

(52) U.S. Cl.
CPC ..... *B65D 2519/00323* (2013.01); *B65D 2519/00333* (2013.01); *B65D 2519/00567* (2013.01); *B65D 2519/00572* (2013.01)

(58) Field of Classification Search
CPC ..... B65D 2519/00333; B65D 2519/00567; B65D 2519/00572; B65D 2519/00547; B65D 2519/00552
USPC ..... 108/51.3, 56.1, 56.3
See application file for complete search history.

(56) References Cited

U.S. PATENT DOCUMENTS 3,149,586 A * 9/1964 Kemp, Jr. ..... B65D 19/0093 108/57.2
5,178,075 A * 1/1993 Kanazawa ..... B65D 19/0069 108/56.1
5,367,960 A * 11/1994 Schleicher ..... B65D 19/0095 108/57.32
5,809,902 A * 9/1998 Zetterberg ..... B65D 19/0073 108/51.11
5,941,179 A * 8/1999 Herring ..... B65D 19/0095 108/56.3
6,766,749 B2 * 7/2004 Lacabanne ..... B65D 19/0095 108/901
7,987,798 B2 * 8/2011 Kim ..... B65D 19/0097 108/57.32
8,291,837 B2 * 10/2012 Kirkpatrick ..... B65D 19/0014 108/51.11
8,424,468 B2 * 4/2013 Aden ..... B65D 19/0026 108/57.32
8,671,848 B2 * 3/2014 Randall ..... B65D 19/0095 108/51.11
2003/0005862 A1 * 1/2003 Halavais ..... B65D 19/0095 108/56.1
2005/0076816 A1 * 4/2005 Nakano ..... G06K 19/07758 108/51.11
2006/0254474 A1 * 11/2006 Roth ..... B65D 19/0095 108/51.11
2007/0245932 A1 * 10/2007 Nielsen ..... B65D 19/0093 108/51.11
2013/0298806 A1 * 11/2013 Johnson ..... B65D 19/0095 108/56.1
2014/0102338 A1 * 4/2014 Stevens ..... B65D 19/0095 108/51.11
2016/0068302 A1 * 3/2016 Clark ..... B65D 19/0085 108/57.32
2019/0092522 A1 * 3/2019 Robinson ..... B65D 19/0081
2020/0002053 A1 * 1/2020 Zhang ..... B65D 19/0095
2020/0239185 A1 * 7/2020 Park ..... B65D 19/0095
2020/0407111 A1 * 12/2020 Kim ..... B65D 19/42

FOREIGN PATENT DOCUMENTS

CN 101613009 B 6/2013
CN 204527964 U 8/2015
CN 108058883 A 5/2018
JP 2004067206 A 3/2004
WO 2011006539 A1 1/2011
WO 2021114033 A1 6/2021

OTHER PUBLICATIONS

International Application Serial No. PCT/CN2019/124054, Search Report dated Aug. 26, 2020, 4 pages.

* cited by examiner

ASSEMBLING COMPONENT HAVING LOCKING MECHANISM

CROSS-REFERENCE TO RELATED APPLICATION

The present application is the U.S. national phase of PCT Application No. PCT/CN2019/124054 filed on 2019 Dec. 9, which is incorporated herein by reference in its entirety and for all purposes.

The present application relates to an assembled unit, and more particularly, to an assembled unit having a locking mechanism. The fields of usage of the assembled unit of the present application include, but are not limited to, transportation (such as pallets), storage, construction (such as frames, supporting brackets), toys (such as assembled toys), and the like.

BACKGROUND

Assembled units are widely used in transportation, construction, toys, among other fields. Assembled units typically have the advantages of fast installation, convenient disassembly, and easy carrying and transportation, among others. For example, patent application number 2009101516204 discloses a pallet, comprising a plurality of assembling components, the main structure of the pallet being formed by assembling lateral guide rails, plate members and spine members together. Compared with conventional wooden pallets, the pallet has the advantages of being safe and convenient to use, easy to repair and low in cost.

However, in order to prevent the assembling components from falling apart during use, additional locking members such as bolts and screws are needed to further lock the assembled structure, which is inconvenient for the assembly and disassembly, repair, and management of the assembled unit.

SUMMARY

The present application provides an assembled unit having a locking mechanism, which addresses the problem of inconvenience of assembly and disassembly of conventional assembled units.

The present application provides an assemblied unit, comprising:

a pair of lateral guide rails, each of the lateral guide rails being configured with a sliding groove along a direction of extension thereof, with openings of the respective sliding grooves of the pair of lateral guide rails facing each other;

a pair of class I plate members disposed between the pair of lateral guide rails, wherein both ends of each of the class I plate members can be inserted into the sliding groove of the corresponding lateral guide rail, both ends of each of the lateral guide rails are respectively configured with an engaging structure, which has an engaging position and a disengaging position, and both ends of each of the class I plate members are configured with a corresponding engaging portion, such that when the engaging portion is slid into the engaging position, the corresponding class I plate member is lockedly engaged with the corresponding lateral guide rail, and when the engaging portion is slid into the disengaging position, the corresponding class I plate member can be disengaged from the sliding groove of the corresponding lateral guide rail;

a spine member configured with a raised sliding block along its direction of extension, wherein on a surface of each of the type I plate members, a class I engaging slot is configured in a direction parallel to the lateral guide rail, the class I engaging slot opening at a side of the class I plate member and terminating at a termination position after it extends across part of a surface of the corresponding plate member, with openings of the class I engaging slots of the pair of class I plate members facing each other; the sliding block of the spine member can be slid in from the opening of the class I engaging slot, and an edge of the sliding block can slidably fit with the class I engaging slot, such that the spine member can be slid along the class I engaging slot but is locked in a direction perpendicular to the surface of the corresponding plate member; and an end of the spine member is configured with a detachment portion having a predetermined length, such that the spine member can be embedded into or detached from the class I engaging slot at the detachment portion in a direction perpendicular to the surface of the corresponding plate member;

at least one eccentric rotation member, wherein a raised rotary sliding block is configured at the bottom of the eccentric rotation member; the rotary sliding block can be slid in from the opening of the class I engaging slot and stay at the termination position of the class I engaging slot, and an edge of the rotary sliding block rotarily fits with the class I engaging slot such that the eccentric rotation member can rotate about a center of the rotary sliding bock but is locked in a direction perpendicular to the surface of the corresponding plate member; and with the rotary sliding block as a starting point, the eccentric rotation member has two arms extending in different directions, with a long arm having a length greater than that of a short arm;

wherein when the assembled unit is to be shifted to an unlocked state, the pair of class I plate members are in the engaging positions, the end of the spine member without the detachment portion is slid into the class I engaging slot having the eccentric rotation member disposed therein and abuts against the short arm of the eccentric rotation member, and the other end of the spine member configured with the detachment portion overlaps the other class I engaging slot, with a length of overlapping not greater than that of the detachment portion such that the spine member at the overlapping position can be directly embedded into the other class I engaging slot; and when the assembled unit is to be shifted from an unlocked state into a locked state, the spine member is slid toward the end thereof configured with the detachment portion until it abuts against the termination position of the type I engaging slot accommodating the detachment portion, a length of the detachment portion is smaller than that of the type I engaging slot accommodating it such that at least part of a length of the type I engaging slot accommodating the detachment portion still fits with the gliding block of the spine member, and the eccentric rotation member is rotated such that its long arm abuts against the end of the spine member without the detachment portion.

The present application has the following beneficial effects:

Due to the disposition of the eccentric rotation member, when the assembled unit is to be shifted to an unlocked state, the short arm of the eccentric rotation member is made to abut against the end of the spine member without the detachment portion, whereupon the end of the spine member configured with the detachment portion can be detached from the class I engaging slot of the class I plate member, such that components of the assembled unit can be dissembled from each other. When the assembled unit is to be shifted to a locked state, the long arm of the eccentric rotation member is made to abut against the end of the spine member without the deteachment portion, whereupon at least part of the length of the class I engaging slot accommodating the detachment portion still fits with the sliding block of the spine member, such that the end of the spine member configured with the detachment portion cannot be detached from the class I engaging slot, thus achieving locking of components of the assembled unit among each other. The eccentric rotation member realizes the locking among components of the assembled unit, without the need for additional locking members such as bolts and screws to lock the assembled unit, which solves the problem of inconvenience in assembly and disassembly associated with existing assembled units.

Figure 1:
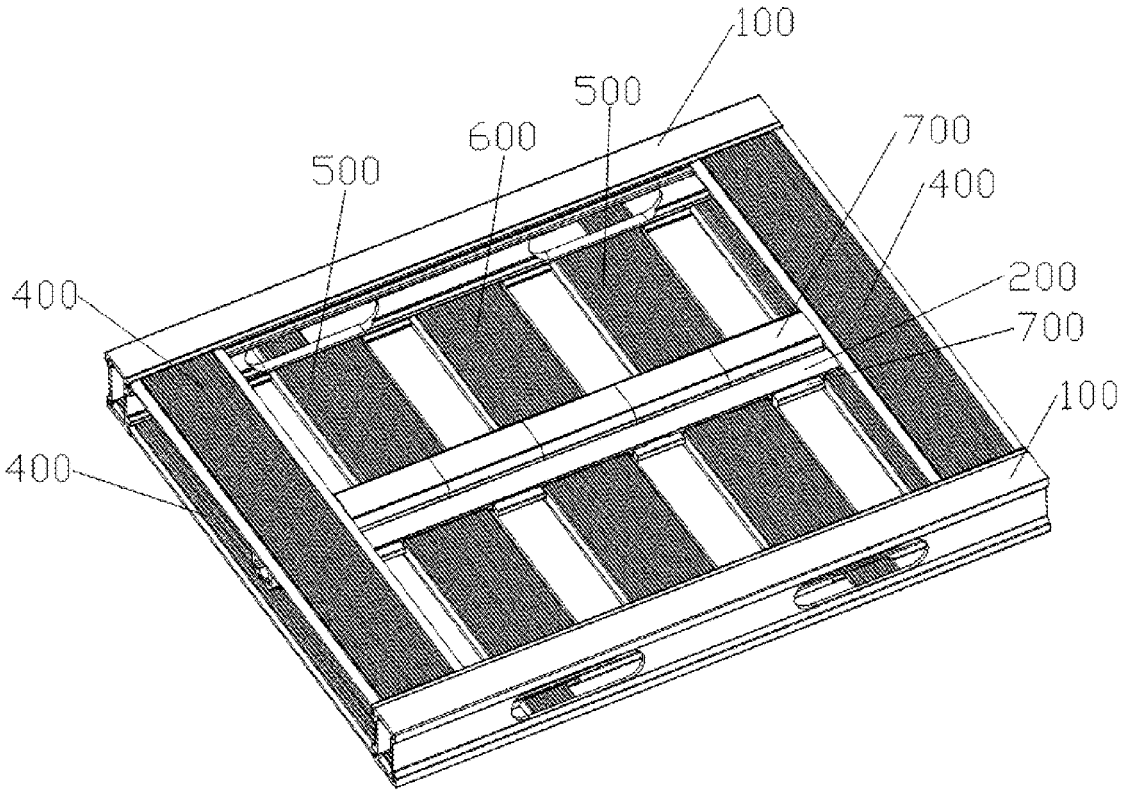
FIG. 1 shows a schematic structural diagram, in a visual angle, of an assembled unit in an embodiment of the present application.

Reference numerals: 100, lateral guide rail; 110, sliding groove; 120, insertion hole; 130, open chamber; 200, spine member; 210, first through hole; 220, sliding block; 230, detachment portion; 300, eccentric rotation member; 310, rotation shaft; 320, long arm; 330, short arm; 340, second through hole; 400, class I plate member; 500, class II plate member; 600, class III plate member; 700, spacer; 800, class I engaging slot; 900, class II engaging slot; 1000, cavity; 1100, engaging portion; 1110, insertion slot; 1200, locking piece; 1210, third through hole.

DETAILED DESCRIPTION

The present application will be further described in detail below with reference to the accompanying drawings, in which like elements in different embodiments are indicated with like reference numerals. In the following embodiments, many details are described so that the present application will be better understood. However, those skilled in the art can readily recognize that some of the features may be omitted, or replaced by other elements, materials, or methods, depending on different situations. In some cases, some operations related to the present application are not shown or described in this specification, so as to avoid overwhelming the core part of the present application with excessive description. Detailed description of these relevant operations is not necessary for those skilled in the art, who can have a complete knowledge of the relevant operations in light of the description in the specification and the general technical knowledge in the art.

Additionally, the characteristics, operations or features described in the specification can be combined in any suitable manner to form various embodiments. Moreover, the steps or actions in the description of the method may also be switched or adjusted in sequence in a manner that is obvious to those skilled in the art. Therefore, the various sequences in the description and the drawings are merely for the purpose of clearly describing a particular embodiment and are not intended to be required, unless it is otherwise specified that a specific sequence must be followed.

The serial numbers per se, such as "first", "second", etc., designated herein for components, are only used for distinguishing the described objects and do not represent any sequence or have any technical meaning. As used herein, "connected" or "coupled" includes both direct and indirect connection (coupling), unless otherwise specified.

The present application provides an assembled unit having a locking mechanism.

Figure 2:
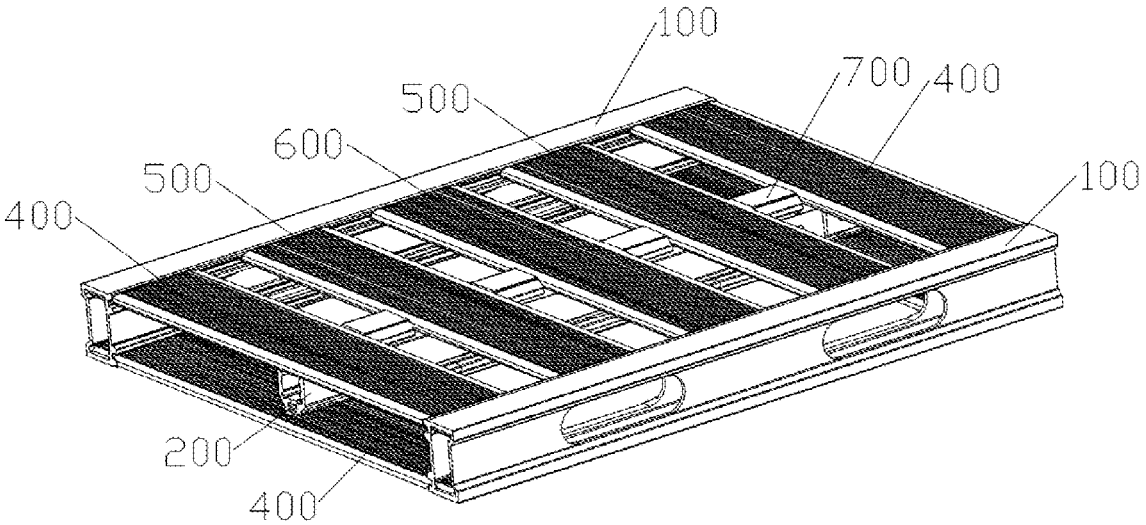
FIG. 2 shows a schematic structural diagram, in another visual angle, of an assembled unit in an embodiment of the present application.
Figure 3:
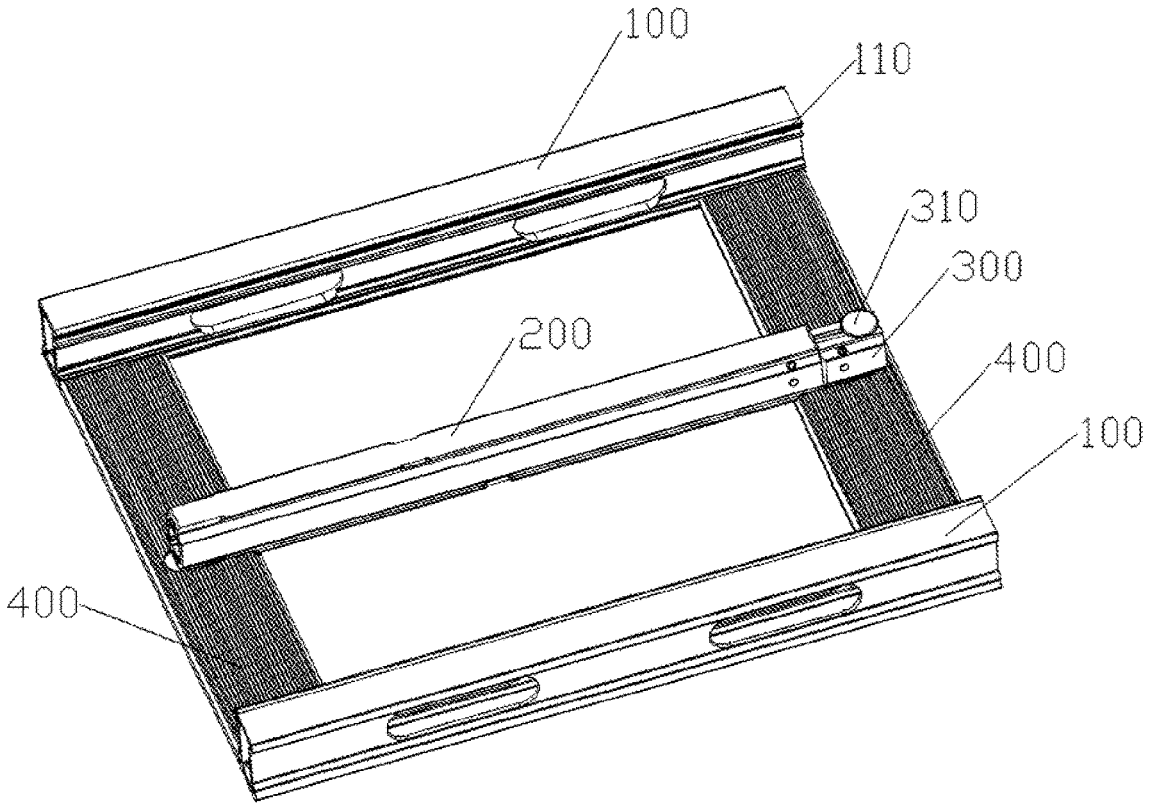
FIG. 3 shows a schematic structural diagram of an assembled unit with the least components assembled in an embodiment of the present application.

With reference to FIGS. 1-3, the assembly structure comprises a pair of lateral guide rails 100, a spine member 200, at least one eccentric rotation member 300, and a pair of class I plate members 400.

Figure 4:
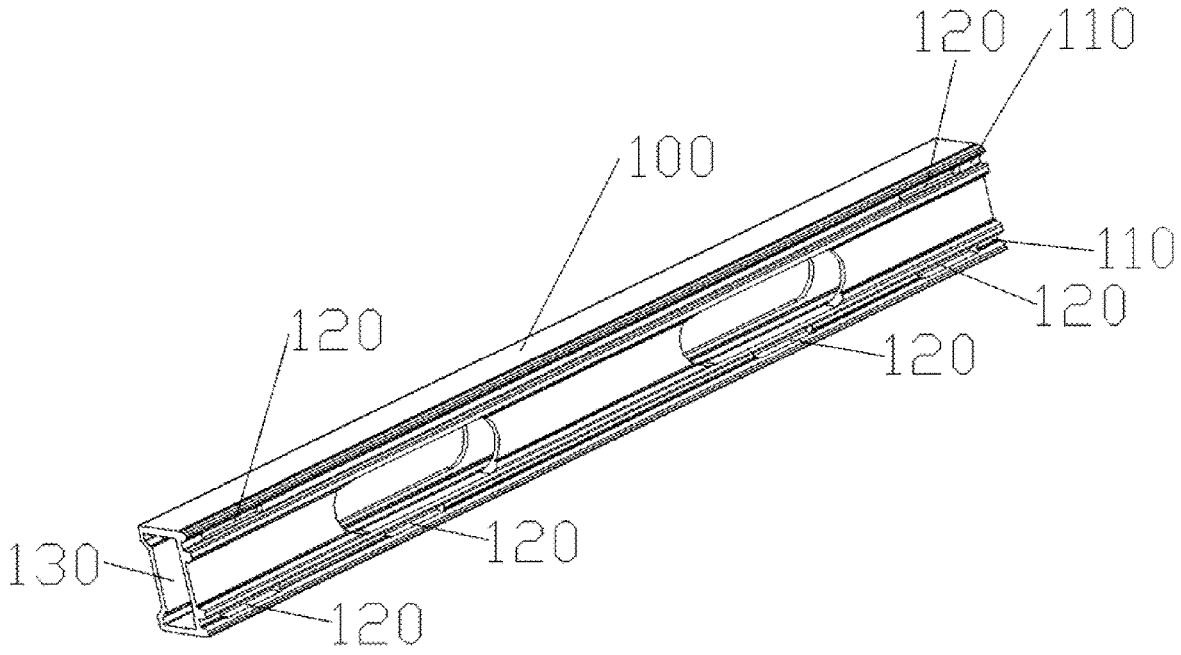
FIG. 4 shows a schematic structural diagram of a lateral guide rail in an embodiment of the present application.

With reference to FIG. 4, each of the lateral guide rails 100 is configured with a sliding groove 110 along a direction of extension thereof, with openings of the respective sliding grooves 110 of the pair of lateral guide rails 100 facing each other.

Figure 5:
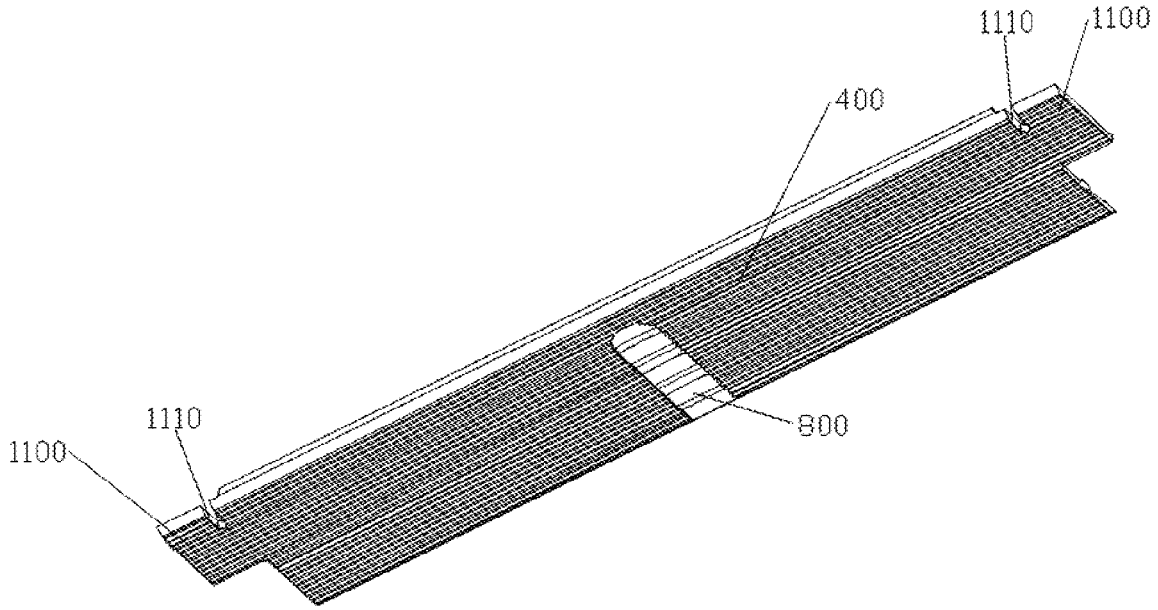
FIG. 5 shows a schematic structural diagram of a class I plate member in an embodiment of the present application.

With reference to FIG. 5, a pair of class I plate members 400 are disposed between the pair of lateral guide rails 100, wherein both ends of each of the class I plate members 400 can be inserted into the sliding groove 110 of the corresponding lateral guide rail 100; both ends of each of the lateral guide rails 100 are respectively configured with an engaging structure, which has an engaging position and a disengaging position; and both ends of each of the class I plate members 400 are configured with a corresponding engaging portion 1100, such that when the engaging portion 1100 is slid into the engaging position, the corresponding class I plate member 400 is lockedly engaged with the lateral guide rail 100, and when the engaging portion 1100 is slid into the disengaging position, the corresponding class I plate member 400 can be disengaged from the sliding groove 110 of the lateral guide rail 100.

Specifically, the engaging portion 1100 is slid from the disengaging position to the engaging position along the sliding groove 110 in a direction towards the end of the lateral guide rail 100 proximal thereto, and conversely, the engaging portion 1100 is slid from the engaging position to the disengaging position along the sliding groove 110 in a direction towards the end of the lateral guid rail 100 distal thereto.

Figure 6:
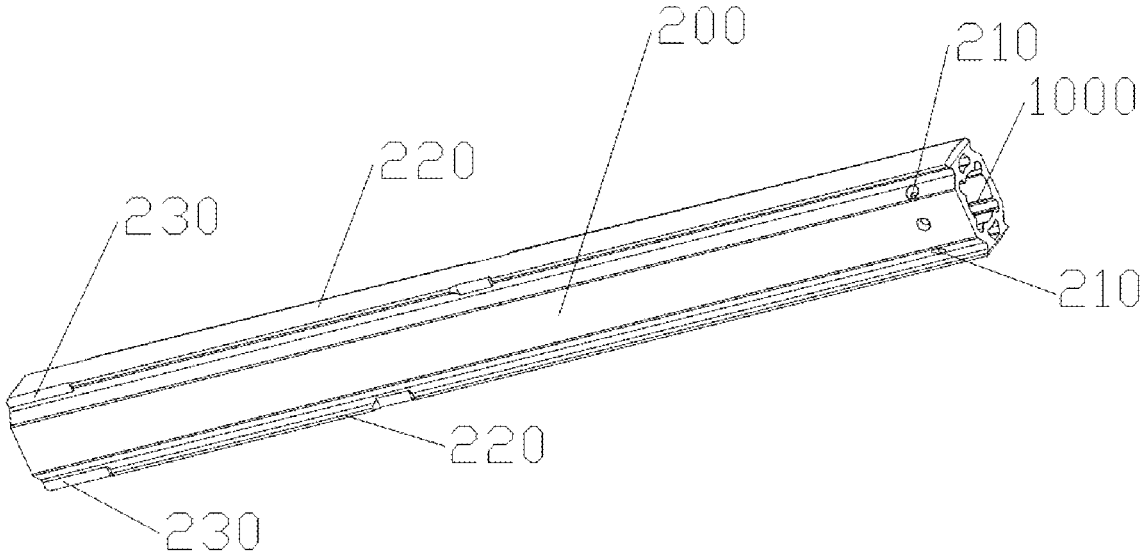
FIG. 6 shows a schematic structural diagram of a spine member in an embodiment of the present application.

With reference to FIG. 6, the spine member 200 is configured with a raised sliding block 220 along a direction of extension thereof. On a surface of each of the type I plate members 400, a class I engaging slot 800 is configured in a direction parallel to the lateral guide rail 100, the class I engaging slot 800 opening at a side of the class I plate member 400 and terminating at a termination position after it extends across part of a surface of the corresponding plate member. The openings of the class I engaging slots 800 of the pair of class I plate members 400 face each other. The sliding block 220 of the spine member 200 can be slid in from the opening of the class I engaging slot 800, and an edge of the sliding block 220 can slidably fit with the class I engaging slot 800, such that the spine member 200 can be slid along the class I engaging slot 800 but is locked in a direction perpendicular to the surface of the corresponding plate member. An end of the spine member 200 is configured with a detachment portion 230 having a predetermined length, such that the spine member 200 can be embedded into or detached from the class I engaging slot 800 at the detachment portion 230 in a direction perpendicular to the surface of the corresponding plate member.

Figure 7:
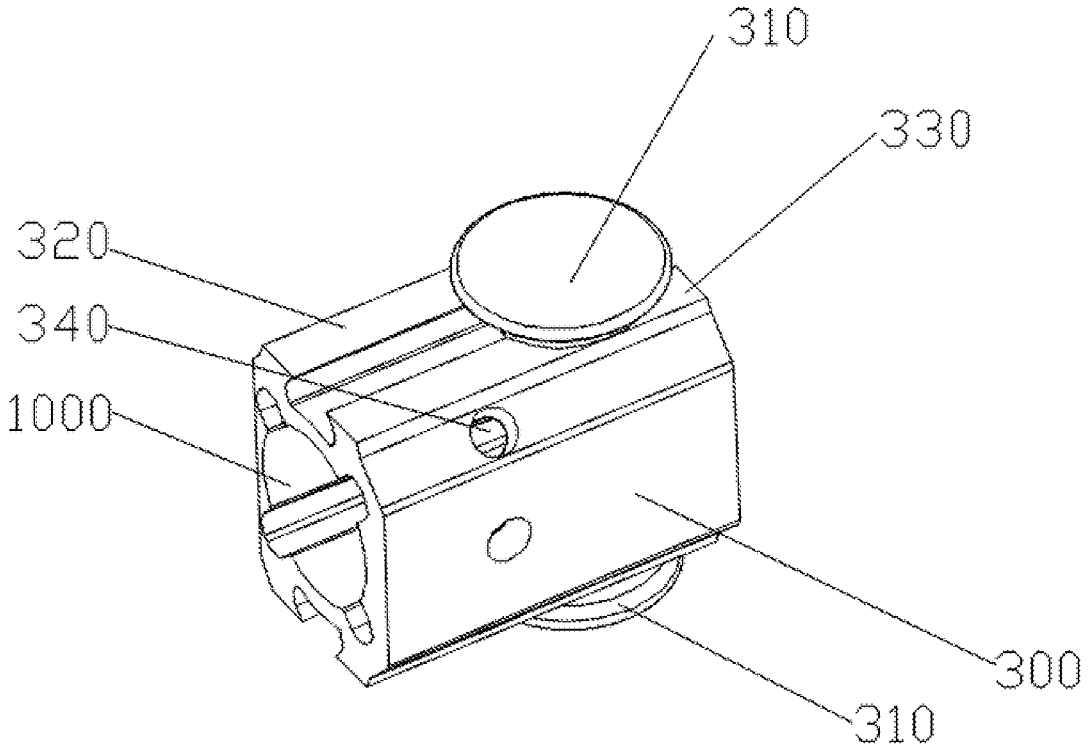
FIG. 7 shows a schematic structural diagram of an eccentric rotation member in an embodiment of the present application.

With reference to FIG. 7, a raised rotary sliding block is configured at the bottom of the eccentric rotation member 300. The rotary sliding block can be slid in from the opening of the class I engaging slot 800 and stay at the termination position of the class I engaging slot 800, and an edge of the rotary sliding block rotarily fits with the class I engaging slot 800 such that the eccentric rotation member 300 can rotate about a center of the rotary sliding bock but is locked in a direction perpendicular to the surface of the corresponding plate member. With the rotary sliding block as a starting point, the eccentric rotation member 300 has two arms extending in different directions, with the long arm 320 having a length greater than that of the short arm 330.

Specifically, the eccentric rotation member 300 defines a locked state and an unlocked state of the assembled unit by means of rotation.

When the assembled unit is to be shifted to an unlocked state, the pair of class I plate members 400 are in the engaging positions. The end of the spine member 200 without the detachment portion 230 is slid into the class I engaging slot 800 having the eccentric rotation member 300 disposed therein and abuts against the short arm 330 of the eccentric rotation member 300, and the other end of the spine member 200 configured with the detachment portion 230 overlaps the other class I engaging slot 800, with a length of overlapping not greater than that of the detachment portion 230 such that the spine member 200 at the overlapping position can be directly embedded into the other class I engaging slot 800.

When the assembled unit is to be shifted from an unlocked state into a locked state, the spine member 200 is slid toward the end thereof configured with the detachment portion 230 until it abuts against the termination position of the type I engaging slot 800 accommodating the detachment portion 230. The length of the detachment portion 230 is smaller than that of the type I engaging slot 800 accommodating it such that at least part of a length of the type I engaging slot 800 accommodating the detachment portion 230 still fits with the gliding block 220 of the spine member 200. The eccentric rotation member 300 is rotated such that its long arm 320 abuts against the end of the spine member 220 without the detachment portion 230.

Due to the disposition of the eccentric rotation member 300, when the assembled unit is to be shifted to an unlocked state, the short arm 330 of the eccentric rotation member 300 is made to abut against the end of the spine member 200 without the detachment portion 230, whereupon the end of the spine member 200 configured with the detachment portion 230 can be detached from the class I engaging slot 800 of the class I plate member 400, such that components of the assembled unit can be dissembled from each other. When the assembled unit is to be shifted to a locked state, the long arm 320 of the eccentric rotation member 300 is made to abut against the end of the spine member 200 without the deteachment portion 230, whereupon at least part of the length of the class I engaging slot 800 accommodating the detachment portion 230 still fits with the sliding block 220 of the spine member 200, such that the end of the spine member 220 configured with the detachment portion 230 cannot be detached from the class I engaging slot 800, thus achieving locking of components of the assembled unit among each other. The eccentric rotation member 300 realizes the locking among components of the assembled unit, without the need for additional locking members such as bolts and screws to lock the assembled unit, which solves the problem of inconvenience in assembly and disassembly associated with existing assembled units.

In one embodiment, the eccentric rotation member 300 is configured with a guide face at a peripheral surface facing the spine member 200 during rotation, so as to guide switching between the long arm 320 and the short arm 330. The guide face helps to guide the rotation of the eccentric rotating member 300, such that the eccentric rotating member 300 can also be rotated smoothly when it abuts against the spine member 200.

With reference to FIGS. 3, 5 and 7, in one embodiment, the eccentric rotation member 300 is bar-shaped, and the rotary sliding block is a rotation shaft 310 perpendicular to a direction of a length of the eccentric rotation member 300 and is disposed away from a center position of the length. An end of the rotation shaft 310 bulges to allow it to rotatably fit in the class I engaging slot 800. The bulged end of the rotation shaft 310 achieves rotary connection of the rotation shaft 310 to the class I engaging slot 800 on the one hand, and prevents the rotation from detaching from the class I engaging slot 800 in a direction perpendicular to the class I plate member 400 on the other hand.

With reference to FIG. 5, in one embodiment, the class I engaging slot 800 has a cross-sectional shape of a swallow-tailed slot, to which a shape of the sliding block 220 of the spine member 200 matches. By using the swallow-tailed slot as the class I engaging slot 800, the sliding block 220 of the spine member 200 can only be slid along a direction of extension of the class I engaging slot 800 and cannot be detached from the class I engaging slot 800 along a direction perpendicular to the class I plate member 400.

In other embodiments, the class I engaging slot 800 may also be a T-shaped slot, an L-shaped slot, an arc-shaped slot with a central angle greater than 180°, and the like, as long as it can prevent the sliding block 220 of the spine member 200 from detaching from the class I engaging slot 800 along a direction perpendicular to the class I plate member 400.

The shape of the sliding block 220 of the spine member 200 matches that of the class I engaging slot 800.

With reference to FIGS. 3, 6 and 7, in one embodiment, the assembled unit further comprises a tying band, the end of the spine member 200 without the detachment portion 230 is configured with at least one first through hole 210, and an end of the long arm 320 of the eccentric rotation member 300 is configured with at least one second through hole 340, such that the tying band is passed through the first through hole 210 and the second through hole 340 and tightened up in a loop in order to fix the locked state when the assembled unit is in the locked state. When the assembled unit is in the locked state, the tying band is passed through the first through hole 210 and the second through hole 340 and tightened up in a loop to prevent rotation of the eccentric rotation member 300 about the rotation shaft 310 so as to achieve fixing of the locked state.

In another embodiment, the eccentric rotation member 300 is provided in a number of two, and the two eccentric rotation members 300 are disposed in the respective class I engaging slots 800 of the pair of class I plate members 400.

With reference to FIGS. 3, 6 and 7, in one embodiment, the spine member 200 and the eccentric rotation member 300 both have a hollow structure. The end of the spine member 200 without the detachment portion 230 is configured with two symmetrically distributed first through holes 210, and the end of the long arm 320 of the eccentric rotation member 300 is configured with two symmetrically distributed second through holes 340, with the positions of the first through holes 210 and the second through holes 340 corresponding to each other. The tying band is successively passed through the adjacent first through holes 210 and second through holes 340 and tightened up in a loop.

With reference to FIGS. 3, 6 and 7, in one embodiment, the end of the spine member 200 without the detachment portion 230 is configured with four symmetrically distributed first through holes 210, and the end of the long arm 320 of the eccentric rotation member 300 is configured with four symmetrically distributed second through holes 340, with the positions of the first through holes 210 and the second through holes 340 corresponding to each other. The tying band is passed through two of the first through holes 210 positioned on a same diagonal line on a cross-section of the spine member and two of the second through holes 340 corresponding to the two of the first through holes 210 and is tightened up in a loop.

Figure 8:
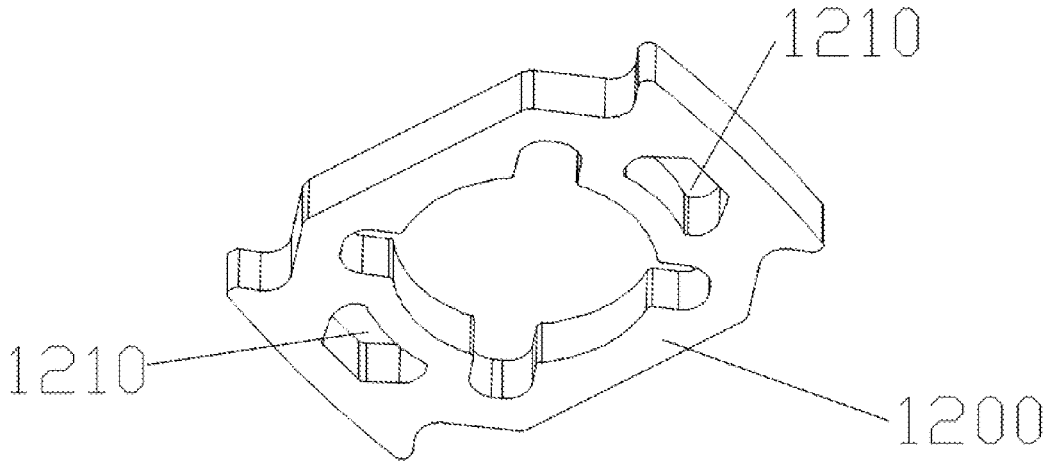
FIG. 8 shows a schematic structural diagram of a locking piece in an embodiment of the present application.
Figure 9:
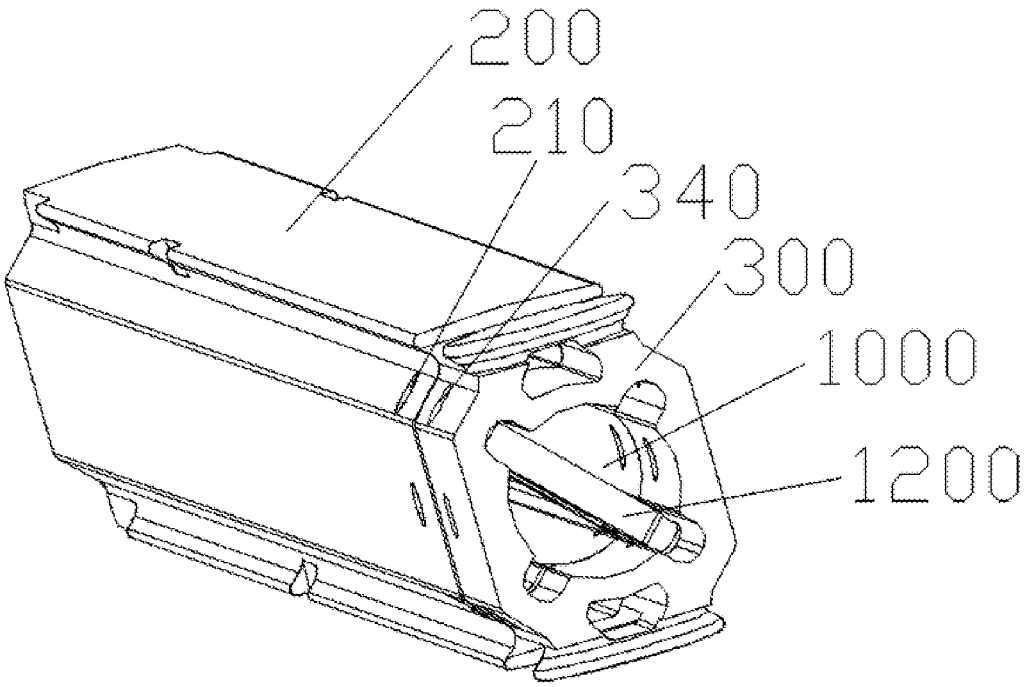
FIG. 9 shows a schematic structural diagram of a locking piece being disposed in the cavities of the spine member and the eccentric rotation member in an embodiment of the present application.

With reference to FIGS. 8 and 9, in one embodiment, the assembled unit further comprises a locking piece 1200, and the spine member 200 and the eccentric rotation member 300 have a cavity 1000. The locking piece 1200 is adapted to be placed on a diagonal line on a cross-section of the cavity, and the locking piece 1200 does not press close to any inner side wall of the cavity 1000, so as to prevent the eccentric rotation member 300 from rotating about a center of the rotary sliding block.

The locking piece 1200 further restricts the rotation of the eccentric rotation member 300. Specifically, a part of the locking piece 1200 is located in the cavity 1000 of the spine member 200, and the other part is located in the cavity 1000 of the eccentric rotation member 300. The included angle between the locking piece 1200 and a side wall of the cavity 1000 may be 30°, 45°, or 60°, etc., as long as the locking piece 1200 does not press close to any inner side wall of the cavity 1000.

With reference to FIGS. 8 and 9, in one embodiment, the locking piece 1200 has a third through hole 1210, and the tying band is passed through the third through hole 1210 to fix the locking piece 1200. The locking piece 1200 is restricted from moving in the cavity 1000, and the locking piece 1200 is prevented from detaching from the cavity 1000.

With reference to FIGS. 6, 8 and 9, in one embodiment, a cross section of the locking piece 1200 has the same shape as a cross section of the spine member 200 and a cross section of the eccentric rotation member 300. As a result, a separate mold is not needed for the locking piece 1200, and the locking piece 1200 can be prepared by directly cutting out from the raw material or residual material of the spine member 200.

In one embodiment, the assembled unit further comprises a chip, which is attached on the locking piece 1200. The chip stores first authentication information, and a surface in a middle portion of the tying band records second authentication information which matches the first authentication information, so that by comparing the first authentication information and the second authentication information, matching between the chip and the tying band can be confirmed. By comparing the first authentication information and the second authentication information, it can be known whether the tying band and the chip match each other, which is convenient for information management and quality control. As the locking piece 1200 is disposed at a certain inclination angle with respect to an inner side wall of the cavity 1000, the chip is positioned at a certain inclination angle with respect to the inner wall of the cavity 1000, which helps to enhance the effect of the chip in receiving and sending signals.

In an embodiment, a surface of an end of the tying band further records third authentication information, the third authentication information matching the first authentication information and the second authentication information. When the tying band is used, the end of the tying band having the recorded third authentication information is cut off to be saved as a stub. By comparing the third authentication information on the stub with the first authentication information and the second authentication information, it can be known whether the tying band or the locking piece 1200 is original.

In one embodiment, the chip also stores material list information of the assembled unit, the material list information including the name, quantity, and records of loss and replacement of components of the assembled unit. The material list information of the assembled unit can be conveniently and quickly stored and retrieved, which is beneficial for optimizing the information management of the assembled unit.

With reference to FIGS. 6-9, in one embodiment, the spine member 200 and the eccentric rotation member 300 have a cavity 1000, and both ends of the tying band can cooperate with each other and be tightened up, the tightening point of the tying band being located inside the cavity 1000.

The tightening point of the tying band is located inside the cavity 1000, so that a user cannot untie the tying band without destroying the structure of the tying band. In other words, if someone else were to disassemble the assembled unit without permission, the tying band must be untied, and the structure of the tying band would necessarily be destroyed, such as by cutting the tying band, which is an irreversible operation that would definitely leave evidence that the assembled unit has been disassembled. At the same time, because the original tying band is associated to the chip and the stub through the authentication information, it is impossible for others to conceal the record of disassembly by substituting a new tying band.

In one embodiment, an end of the tying band has a length margin after tightening up, and the length margin extends toward the cavity 1000 of the spine member 200. By making the length margin extended into the cavity 1000 of the spine member 200, it is more difficult for others to get access to the tightening point of the tying band.

With reference to FIGS. 4, 5, 15 and 16, in one embodiment, a first locking structure comprises an insertion hole 120, the insertion hole 120 being disposed in the sliding groove 110, and the lateral guide rail 100 has an open chamber 130, the insertion hole 120 bringing the sliding groove 110 into communication with the open chamber 130. The engaging portion 1100 extends through the insertion hole 120 into the open chamber 130. The engaging portion 1100 has an insertion slot 1110, such that when the engaging portion 1100 is slid into the engaging position, the insertion slot 1110 engages with a chamber wall of the open chamber 130, and when the engaging portion 1100 is slid into the disengaging position, the insertion slot 1110 disengages from the chamber wall of the open chamber 130. During assembling the assembled unit, the engaging portion 1100 of a plate member is placed into the insertion hole 120. To fasten the plate member, the engaging portion 1100 is slid against the chamber wall corresponding to the insertion slot 1110 thereof such that the insertion slot 1110 engages with the chamber wall of the open chamber 13. To unfasten the plate member, the engaging portion 1100 is slid away from the chamber wall being engaged with the insertion slot 1110 such that the insertion slot 1110 disengages from the chamber wall.

Figure 10:
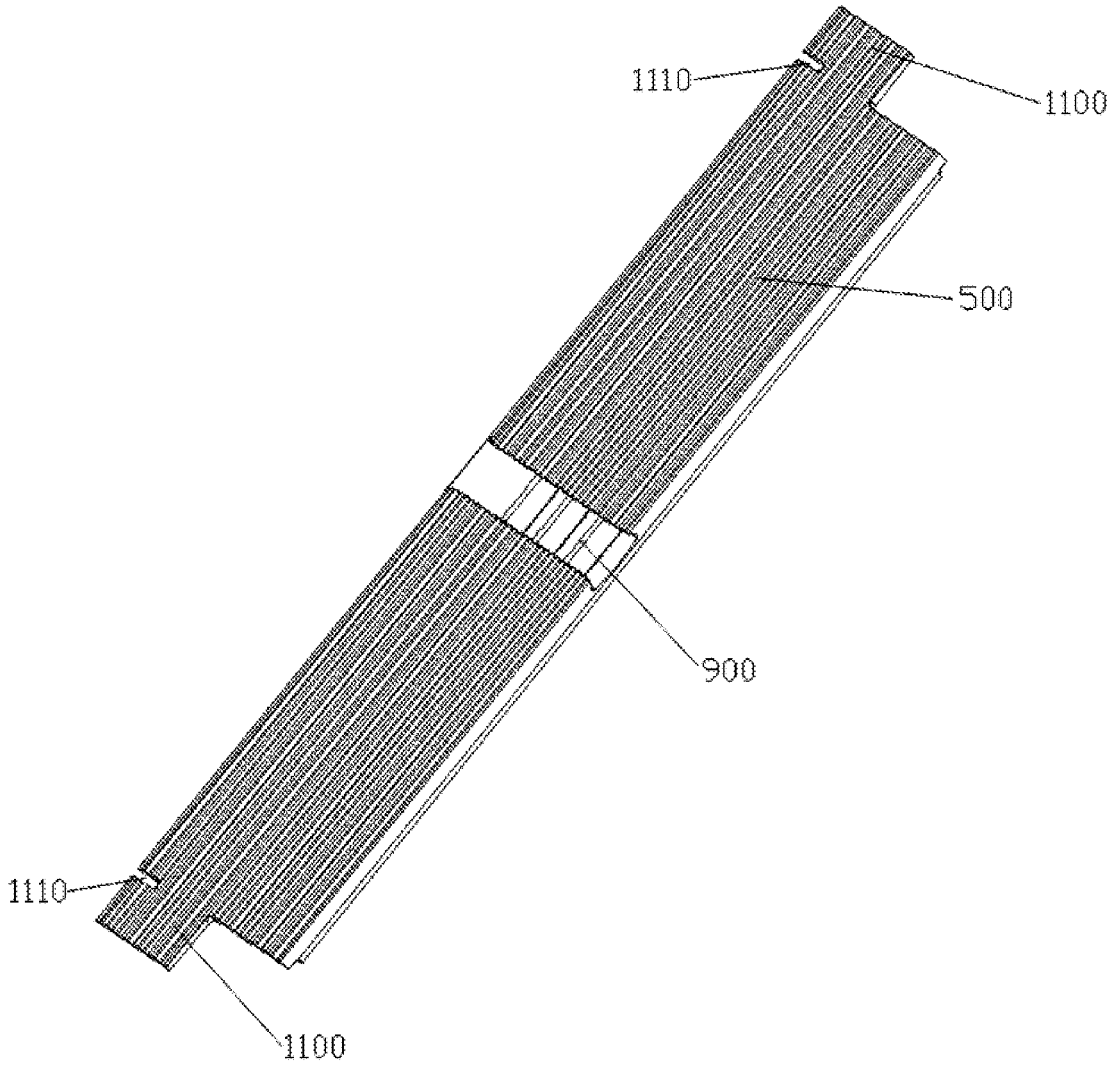
FIG. 10 shows a schematic structural diagram of a class II plate member in an embodiment of the present application.
Figure 11:
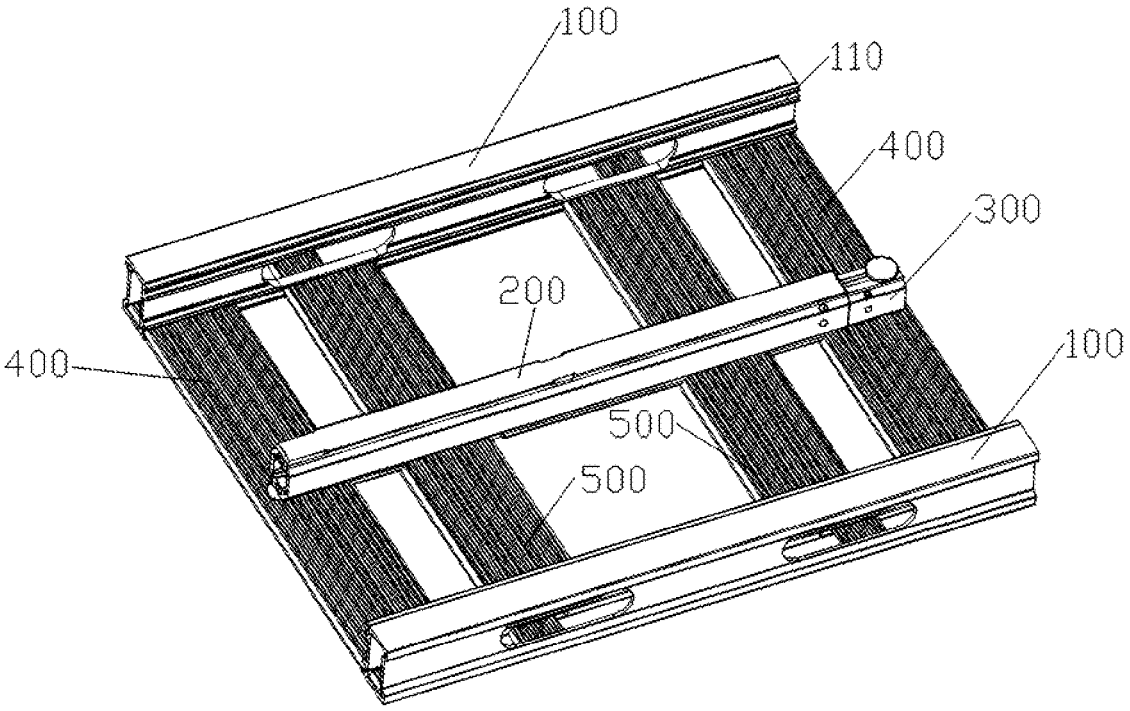
FIG. 11 shows a schematic structural diagram of an assembled unit with a class II plate member having been assembled in an embodiment of the present application.

With reference to FIGS. 10 and 11, in one embodiment, the assembled unit further comprises a class II plate member 500, which is disposed between the pair of class I plate members 400. Both ends of each class II plate member 500 can be inserted into the corresponding sliding grooves 110 of the two lateral guide rails 100. Each of the lateral guide rails 100 has engaging structures configured at positions other than both ends thereof. Each class II plate member 500 has a corresponding engaging portion 1100 disposed at both ends thereof. When the engaging portion 1100 is slid into the engaging position, the corresponding class II plate member 500 engages with the lateral guide rail 100, and when the engaging portion 1100 is slid into the disengaging position, the corresponding class II plate member 500 can be disengaged from the sliding groove 110 of the lateral guide rail 100.

On a surface of each class II plate member 500, a class II engaging slot 900 is disposed in a direction parallel to the lateral guide rail 100. The class II engaging slot 900 extends across a whole surface of the corresponding plate member and matches the position of the engaging slot on an adjacent plate member. The sliding block 220 of the spine member 200 can slidably fit with the class II engaging slot 900, such that the spine member 200 can be slid along the class II engaging slot 900 but is locked in a direction perpendicular to the surface of the corresponding plate member.

Figure 12:
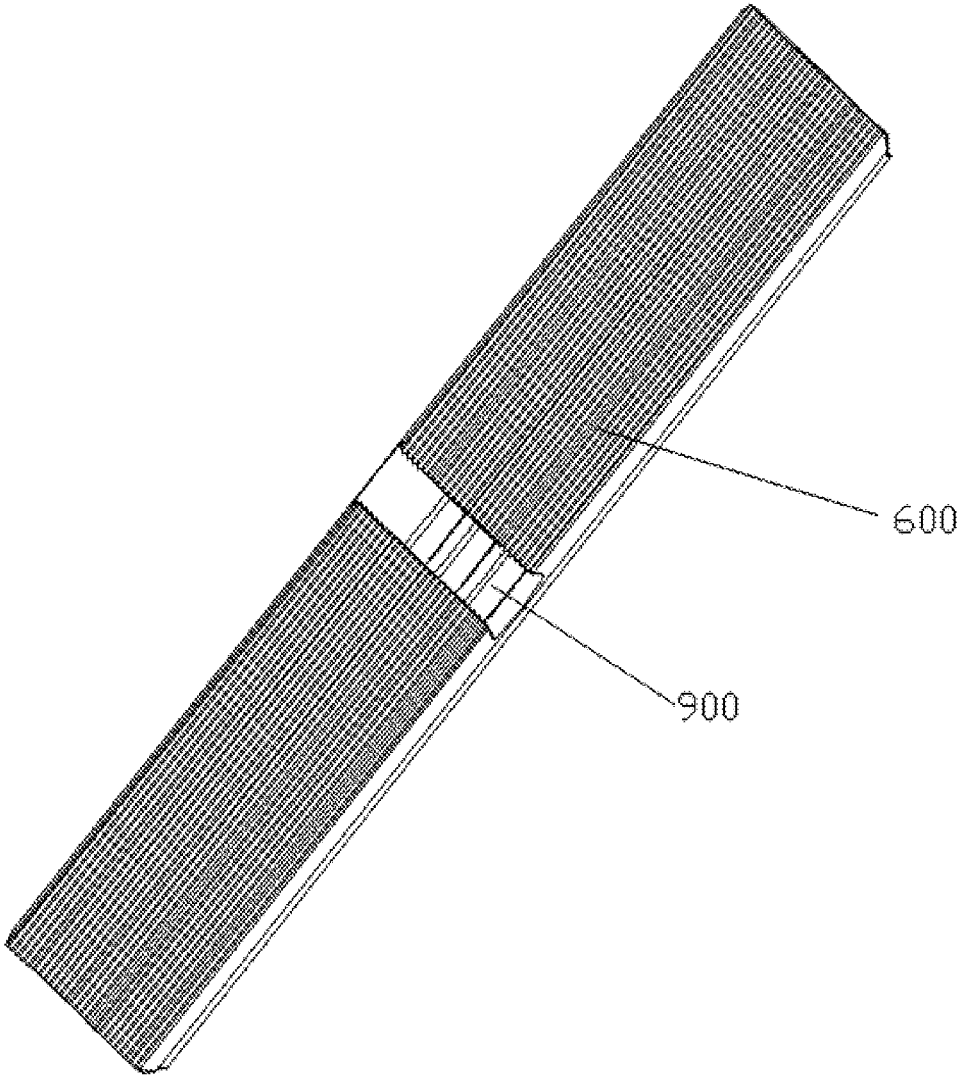
FIG. 12 shows a schematic structural diagram of a class III plate member in an embodiment of the present application.
Figure 13:
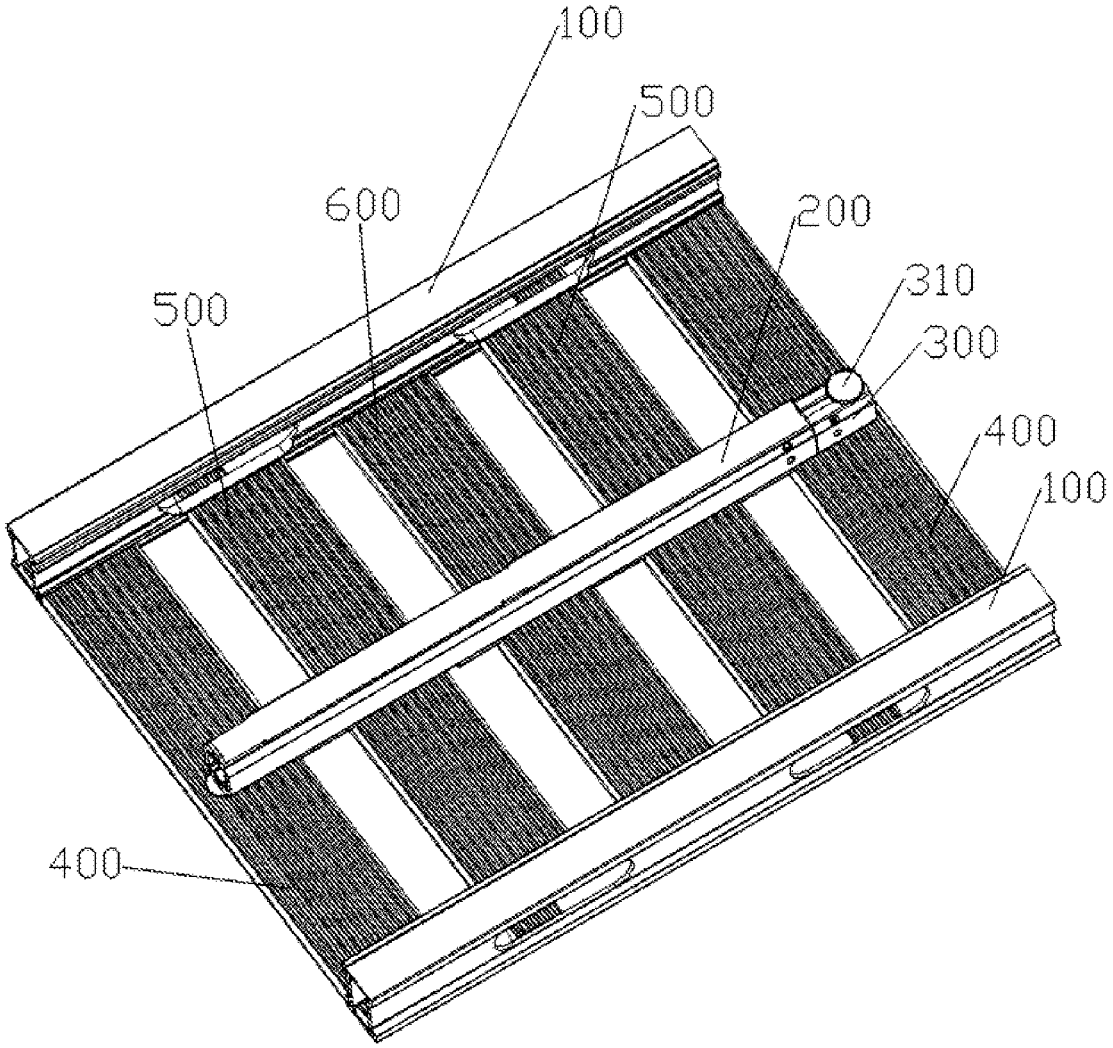
FIG. 13 shows a schematic structural diagram of an assembled unit with a class III plate member having been assembled in an embodiment of the present application.

With reference to FIGS. 12 and 13, in one embodiment, the assembled unit further comprises a class Ill plate member 600, which is disposed between the pair of class I plate members 400. Both ends of each class Ill plate member 600 can be inserted into the corresponding sliding grooves 110 of the lateral guide rails 100 and slid freely along the sliding groove 110. On a surface of each class Ill plate member 600, a class II engaging slot 900 is disposed in a direction parallel to the lateral guide rail 100. The class II engaging slot 900 extends across a whole surface of the corresponding plate member and matches the position of the engaging slot on an adjacent plate member. The sliding block 220 of the spine member 200 can slidably fit with the class II engaging slot 900, such that the spine member 200 can be slid along the class II engaging slot 900 but is locked in a direction perpendicular to the surface of the corresponding plate member.

The structural strength of the assembled unit is enhanced by the class II plate member 500 and the class Ill plate member 600. The class II plate member 500 can fit with the insertion hole 120 of the lateral guide rail 100 to achieve positioning, and the class Ill plate member 600 can be slid freely along the sliding groove 110 of the lateral guide rail 100.

Figure 14:
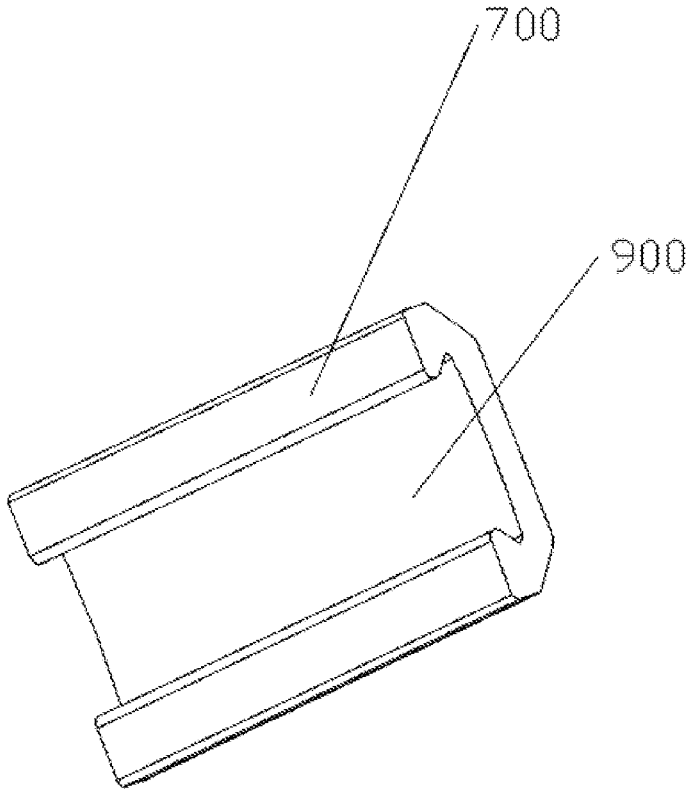
FIG. 14 shows a schematic structural diagram of a spacer in an embodiment of the present application.
Figure 15:
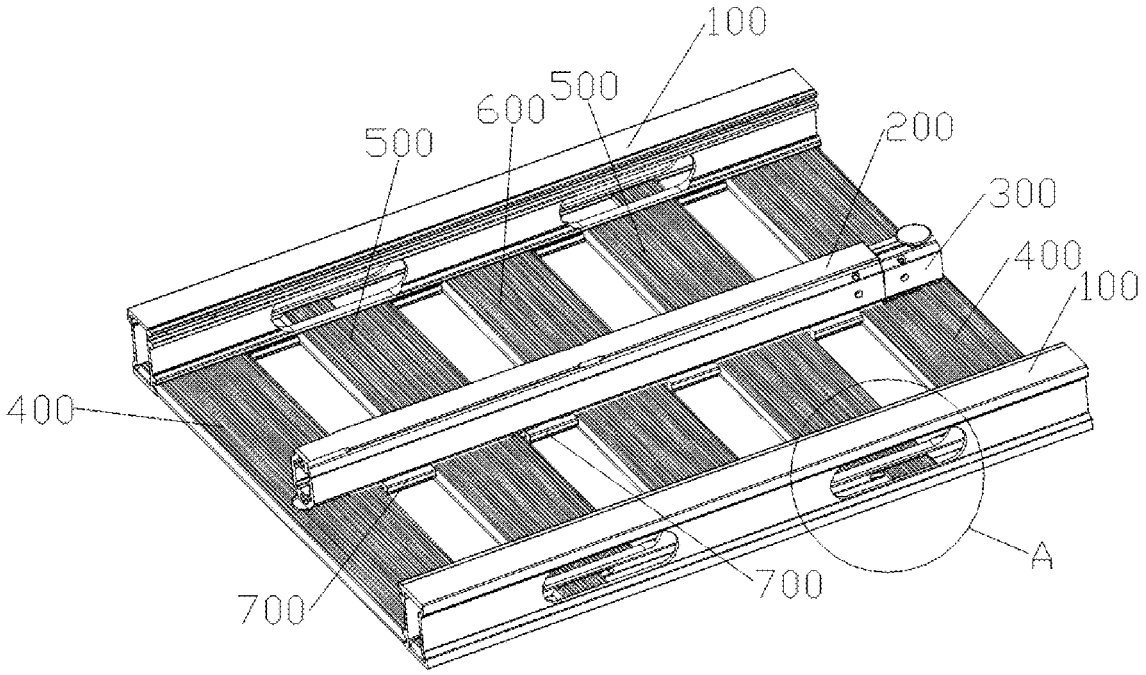
FIG. 15 shows a schematic structural diagram of an assembled unit with a spacer having been assembled in an embodiment of the present application.
Figure 16:
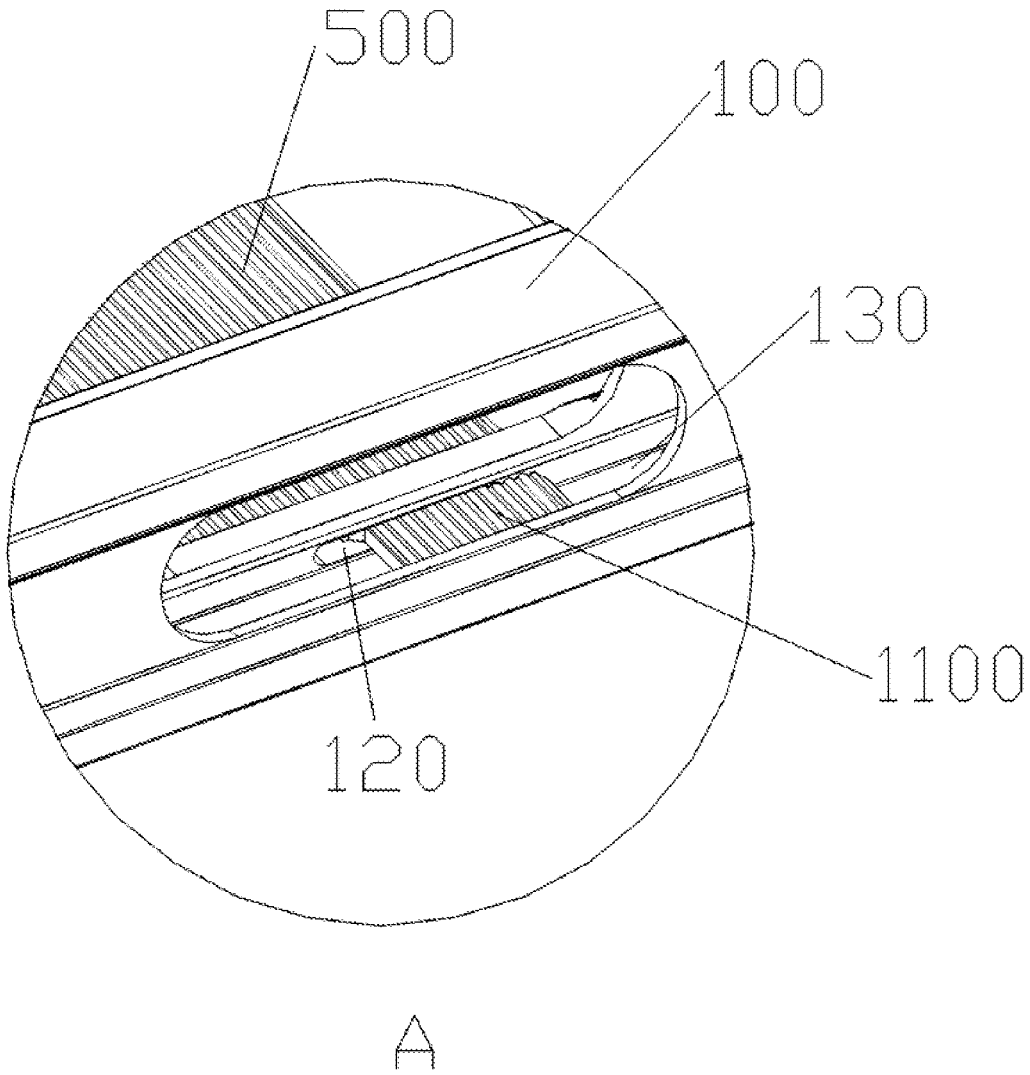
FIG. 16 shows an enlarged view of the position A in FIG. 15 in an embodiment of the present application.

With reference to FIGS. 14 and 15, in one embodiment, the assembled unit further comprises a spacer 700 disposed between plate members and/or spacers 700 for filling a gap between adjacent plate members and/or spacers 700. On a surface of each spacer 700, a class II engaging groove 900 is disposed in a direction parallel to the lateral guide rail 100. The class II engaging slot 900 extends across a whole surface of the corresponding spacer 700 and matches the position of the engaging slots on adjacent plate members and/or spacers 700. The sliding block 220 of the spine member 200 can slidably fit with the class II engaging slot 900, such that the spine member 200 can be slid along the class II engaging slot 900 but is locked in a direction perpendicular to the surface of the corresponding spacer 700. By filling the gap between adjacent plate members and/or spacers 700 with the spacer 700, displacement of the plate members and/or spacers 700 can be prevented, which is beneficial for enhancing the structural stability and safety of the assembled unit.

With reference to 1 and 2, in one embodiment, the lateral guide rail 100 has a double-layer structure. The first and second layers of the lateral guide rail 100 are configured with sliding grooves 110 parallel to each other. Plate members can be installed on the first and second layers of the lateral guide rail 100. The engaging slot of the plate member on the first layer is disposed opposite to the engaging slot of the plate member on the second layer. Sliding blocks 220 are configured on opposite sides of the spine member 200. The gliding blocks 220 on both sides of the spine member 200 respectively fit with the engaging slot of the plate member on the first layer and the engaging slot of the plate member on the second layer. When the detachment portion 230 of the spine member 200 is made to detach from the class I engaging slot 800, the class I plate member 400 can be deformed slightly, such that the spine member 200 can be disengaged from the class I engaging slot 800 in a direction perpendicular to the corresponding class I plate member 400. Use of the double-layer structure is beneficial for enhancing the structural strength of the assembled unit.

The present disclosure invention has been described above with reference to specific examples, which are merely intended to aid the understanding of the present disclosure and are not intended to limit the present disclosure n thereto. Several simple derivations, variations or substitutions can be made by a person skilled in the art to which the present disclosure pertains in light of the concept of the present disclosure.

The invention claimed is:

1. An assembled unit having a locking mechanism, the assembled unit comprising:

a pair of lateral guide rails, each of the lateral guide rails being configured with a sliding groove along a direction of extension thereof, with openings of the respective sliding grooves of the pair of the lateral guide rails facing each other;

a pair of first plate members disposed between the pair of the lateral guide rails, wherein both ends of each of the first plate members are inserted into the sliding groove of a corresponding one of the lateral guide rails, both ends of each of the lateral guide rails are respectively configured with an engaging structure, which has an engaging position and a disengaging position, and both ends of each of the first plate members are configured with a corresponding engaging portion, such that when the engaging portion is slid into the engaging position, the corresponding one of the first plate members is lockedly engaged with the corresponding one of the lateral guide rails, and when the engaging portion is slid into the disengaging position, the corresponding one of the first plate members are disengageable from the sliding groove of the corresponding one of the lateral guide rails;

a spine member configured with a raised sliding block along its direction of extension, wherein on a surface of each of the first plate members, a first engaging slot extends in a direction parallel to the lateral guide rails, the first engaging slot opening at a side of each of the first plate members and terminating at a termination position after it extends across part of a surface of the corresponding plate member, with openings of the first engaging slots of the pair of first plate members facing each other;

the sliding block of the spine member is slidable out the opening of the first engaging slot, and an edge of the sliding block can slidably fit with the first engaging slot, such that the spine member is slidable along the first engaging slot but is locked in a direction perpendicular to the surface of the corresponding plate member; and an end of the spine member is configured with a detachment portion having a predetermined length, such that the spine member can be embedded into or detached from the first engaging slot at the detachment portion in a direction perpendicular to the surface of the corresponding plate member; and at least one eccentric rotation member, wherein a raised rotary sliding block is configured at the bottom of the eccentric rotation member;

the rotary sliding block is slidable out the opening of the first engaging slot and stay at the termination position of the first engaging slot, and an edge of the rotary sliding block rotarily fits with the first engaging slot such that the eccentric rotation member is rotatable about a center of the rotary sliding bock but is locked in a direction perpendicular to the surface of the corresponding one of the first plate members; and with the rotary sliding block as a starting point, the eccentric rotation member has two arms extending in different directions, with a long arm having a length greater than that of a short arm;

wherein when the assembled unit is to be shifted to an unlocked state, the pair of first plate members are in the engaging positions, the end of the spine member without the detachment portion is slid into the first engaging slot having the eccentric rotation member disposed therein and abuts against the short arm of the eccentric rotation member, and the other end of the spine member configured with the detachment portion overlaps the other first engaging slot, with a length of overlapping not greater than that of the detachment portion such that the spine member at the overlapping position can be directly embedded into the other first engaging slot; and when the assembled unit is to be shifted from an unlocked state into a locked state, the spine member is slid toward the end thereof configured with the detachment portion until it abuts against the termination position of the first engaging slot accommodating the detachment portion, a length of the detachment portion is smaller than that of the first engaging slot accommodating it such that at least part of a length of the first engaging slot accommodating the detachment portion still fits with the gliding block of the spine member, and the eccentric rotation member is rotated such that its long arm abuts against the end of the spine member without the detachment portion.

2. The assembled unit according to claim 1, wherein the eccentric rotation member is configured with a guide face at a peripheral surface facing the spine member during rotation, so as to guide switching between the long arm and the short arm.

3. The assembled unit according to claim 1, wherein the eccentric rotation member is bar-shaped, and the rotary sliding block is a rotation shaft perpendicular to a direction of a length of the eccentric rotation member and is disposed away from a center position of the length, and an end of the rotation shaft bulges to allow the rotation shaft to rotatably fit in the first engaging slot.

4. The assembled unit according to claim 1, wherein the first engaging slot has a cross-sectional shape of a swallow-tailed slot, to which a shape of the sliding block of the spine member matches.

5. The assembled unit according to claim 1, wherein the eccentric rotation member is provided in a number of two, and the two eccentric rotation members are disposed in the respective first engaging slots of the pair of first plate members.

6. The assembled unit according to claim 1, wherein the assembled unit further comprises a tying band, the end of the spine member without the detachment portion is configured with at least one first through hole, and an end of the long arm of the eccentric rotation member is configured with at least one second through hole, such that the tying band is passed through the first through hole and the second through hole and tightened up in a loop in order to fix the locked state when the assembled unit is in the locked state.

7. The assembled unit according to claim 6, wherein the spine member and the eccentric rotation member both have a hollow structure, the end of the spine member without the detachment portion is configured with two symmetrically distributed first through holes, and the end of the long arm of the eccentric rotation member is configured with two symmetrically distributed second through holes, with positions of the first through holes and the second through holes corresponding to each other, and the tying band is successively passed through the adjacent first through holes and second through holes and tightened up in a loop.

8. The assembled unit according to claim 6, wherein the end of the spine member without the detachment portion is configured with four symmetrically distributed first through holes, and the end of the long arm of the eccentric rotation member is configured with four symmetrically distributed second through holes, with positions of the first through holes and the second through holes corresponding to each other, and the tying band is passed through two of the first through holes positioned on a same diagonal line on a cross-section of the spine member and two of the second through holes corresponding to the two of the first through holes and is tightened up in a loop.

9. The assembled unit according to claim 6, wherein the assembled unit further comprises a locking piece, the spine member and the eccentric rotation member have a cavity, the locking piece is adapted to be placed on a diagonal line on a cross-section of the cavity, and the locking piece does not press close to any inner side wall of the cavity, so as to prevent the eccentric rotation member from rotating about a center of the rotary sliding block.

10. The assembled unit according to claim 9, wherein the locking piece has a third through hole, and the tying band is passed through the third through hole to fix the locking piece.

11. The assembled unit according to claim 9, wherein a cross section of the locking piece has the same shape as a cross section of the spine member and a cross section of the eccentric rotation member.

12. The assembled unit according to claim 6, wherein the spine member and the eccentric rotation member have a cavity, and both ends of the tying band can cooperate with each other and be tightened up, the tightening point of the tying band being located inside the cavity.

13. The assembled unit according to claim 12, wherein an end of the tying band has a length margin after tightening up, and the length margin extends toward the cavity of the spine member.

14. The assembled unit according to claim 1, wherein a surface of an end of the tying band further records third authentication information, the third authentication information matching the first authentication information and the second authentication information, and when the tying band is used, the end of the tying band having the recorded third authentication information is cut off to be saved as a stub.

15. The assembled unit according to claim 1, wherein a first locking structure comprises an insertion hole, the insertion hole being disposed in the sliding groove, and the lateral guide rail has an open chamber, the insertion hole bringing the sliding groove into communication with the open chamber, the engaging portion extends through the insertion hole into the open chamber, and the engaging portion has an insertion slot, such that when the engaging portion is slid into the engaging position, the insertion slot engages with a chamber wall of the open chamber, and when the engaging portion is slid into the disengaging position, the insertion slot disengages from the chamber wall of the open chamber.

16. The assembled unit according to claim 1, wherein the assembled unit further comprises a second plate member, which is disposed between the pair of first plate members, both ends of each second plate member are inserted into the corresponding sliding grooves of the two lateral guide rails, each of the lateral guide rails has said engaging structures configured at positions other than both ends thereof, each second plate member has a corresponding engaging portion disposed at both ends thereof; when the engaging portion is slid into the engaging position, the corresponding second plate member engages with the lateral guide rail, and when the engaging portion is slid into the disengaging position, the corresponding second plate member can be disengaged from the sliding groove of the lateral guide rail;

and on a surface of each second plate member, a second engaging slot is disposed in a direction parallel to the lateral guide rail, the second engaging slot extends across a whole surface of the second plate member and matches the position of the engaging slot on an adjacent plate member, the sliding block of the spine member can slidably fit with the second engaging slot, such that the spine member is slidable can be slid along the second engaging slot but is locked in a direction perpendicular to the surface of the corresponding plate member.

17. The assembled unit according to claim 1, wherein the assembled unit further comprises a third plate member, which is disposed between the pair of first plate members, wherein:

both ends of each third plate member is insertable inserted into the corresponding sliding grooves of the lateral guide rails and slid freely along the sliding groove;

on a surface of each third plate member, a second engaging slot is disposed in a direction parallel to the lateral guide rail;

the second engaging slot extends across a whole surface of the third plate member and matches the position of the engaging slot on an adjacent plate member; and the sliding block of the spine member can slidably fit with the second engaging slot, such that the spine member can be slid along the second engaging slot but is locked in a direction perpendicular to the surface of the corresponding plate member.

* * * * *